United States Patent [19]

Zurbrüggen

[11] 4,267,963

[45] May 19, 1981

[54] SAFETY DEVICE FOR CENTRIFUGAL SEPARATOR

[75] Inventor: Hugo Zurbrüggen, Oelde, Fed. Rep. of Germany

[73] Assignee: Westfalia Separator Aktiengesellschaft, Oelde Westfalen, Fed. Rep. of Germany

[21] Appl. No.: 89,701

[22] Filed: Oct. 30, 1979

[30] Foreign Application Priority Data

Oct. 30, 1978 [DE] Fed. Rep. of Germany ..... 2847106

[51] Int. Cl.[3] ..... B04B 7/06; B04B 11/08

[52] U.S. Cl. ..... 233/1 B

[58] Field of Search ..... 233/1 B, 1 R, 1 A, 46, 233/27, 28, 38, 47 R, 16, 19 R

[56] References Cited

U.S. PATENT DOCUMENTS

| | | | |
|---|---|---|---|
| 3,108,954 | 10/1963 | Steinacker | 233/1 B |
| 3,163,600 | 12/1964 | Buss | 233/1 B |
| 3,873,020 | 3/1975 | Bodemar | 233/1 B |
| 4,105,903 | 8/1978 | Shaw | 233/1 B |

FOREIGN PATENT DOCUMENTS

| | | |
|---|---|---|
| 1101296 | 3/1961 | Fed. Rep. of Germany . |
| 1159861 | 12/1963 | Fed. Rep. of Germany . |

*Primary Examiner*—Robert W. Jenkins

*Attorney, Agent, or Firm*—Sprung, Felfe, Horn, Lynch & Kramer

[57] ABSTRACT

Safety device for centrifugal separator for preventing a disassembly when the drum is rotating. Tipping lever 25 (FIG. 1) is fastened to the offtake 19 which is for removing separated liquid. The tipping lever extends through an opening 27 in hood 2 which is stationary. By magnetic attraction of a permanent magnet 14, which is mounted on the drum, the tipping lever is pulled inwardly so that it engages the inner edge of opening 27 and thereby locks the offtake on the hood. The magnet 14 extends only partway around the drum and when the drum is stopped the offtake can be rotated so that the tipping lever is out of the reach of the magnet 14. The opening 27 is elongated to permit rotating of the offtake.

8 Claims, 3 Drawing Figures

SAFETY DEVICE FOR CENTRIFUGAL SEPARATOR

BACKGROUND

The invention relates to a safety device for a centrifugal separator having a rotating centrifuge drum for the separation or clarification of liquid mixtures, having a hood disposed on the separator housing and surrounding with clearance the centrifuge drum, having an inlet tube centrally disposed in the hood top for the liquid to be separated or clarified, and having one or more paring disks fastened to the hood top and disposed in the drum top with clearance from the drum for the withdrawal of the separated and clarified liquid phases, the shafts of the paring disks being surrounded by an offtake fastened to the hood top.

Safety devices for such centrifugal separators are known and are intended to prevent the loosening of the fittings or the opening of the hood while the drum is rotating and to permit same only when the drum is at a standstill. When the fittings are loosened or the hood is opened, the paring disks disposed in the drum top may either drop down into the drum or come in contact with the drum so as to be caught by the rotating drum, frequently causing considerable damage to the separator and endangering the personnel.

German Pat. No. 1,101,296 has disclosed a safety device for such a centrifugal separator, in whch a gripping body is disposed in the offtake on the hood of the separator for the fastening of the paring disk shaft, and the gripping body is locked against rotation while the drum is rotating. The locking device consists of a rotatable or displaceable element which by spring force can be displaced to the one end position and can be shifted electrically against the spring force to the other end position. The dependence of the locking action on the rotation of the drum is brought about by providing on a shaft of the separator drive a generator which produces the electrical voltage. This voltage, however, is so low when the drum is turning at low speed that it is not an adequate locking voltage.

According to German Petty Patent No. 6,948,132, another, expensive safety device is proposed for centrifugal separators which involves a standstill detector which keeps the line connections locked until the drum is at an absolute standstill. The standstill detector is based essentially on an inductive probe supplied with high frequency voltage, and a disk disposed on a drive shaft and provided on its circumference with a plurality of notches or projections which when the shaft rotates move past the probe and produce a modulation of the high-frequency voltage. This is used as a locking voltage for the line connections fastened to the hood.

German Pat. No. 2,046,084 discloses a mechanically acting safety device for solid jacket centrifugal separators, in which an element which is displaceable towards the drum and can swing away therefrom and which upon contacting the rotating drum holds the hood or the fittings locked and unlocks them when the drum is standing still. Such safety devices, which are subject to wear against the rotating drum and have a mechanism that is liable to give trouble, are not very desirable.

German Auslegeschrift No. 1,159,861 discloses, in connection with an electrical control system, the disposition of a permanent magnet as a pulse generator on a centrifugal drum, the permanent magnet producing, as it passes an induction coil provided on the separator housing, pulses which are fed through an amplifier to a thyrotron which is extinguished by the occurence of a current pulse and remains extinguished as long as additional current pulses are generated in sufficiently close sequence, thereby preventing the actuation of a relay until no more current pulses occur within a predetermined time span and thereby the locking of the separator cover is released. This apparatus does not release the lock until the separator comes to a stop, but, due to its construction and the use of complex and delicate elements, it is so delicate that its reliability is impaired.

THE INVENTION

The object of the present invention is to create a safety device of the simplest and least expensive kind for centrifuges of the above-named type of construction, which by mechanical means will hold the external removable centrifugal separator parts surrounding the drum locked as long as the drum is in rotation.

These parts of the separator are primarily the fittings such as the offtakes and paring disks as well as the hood, which, if removed too soon, i.e., while the drum is still rotating, can cause damage to equipment and injury to personnel. These parts are commonly removed in the following order: offtakes, hood, paring disks.

In accordance with the invention this object is achieved by providing one or more uniformly distributed permanent magnets which keep the outer, removable centrifugal separator parts, such as offtakes, hood, and paring disks connected therewith, locked during the rotation of the drum, doing so by means of one or more locks disposed on the external centrifugal separator parts and responding to magnetic and lever action.

In one particular embodiment, the lock consists of a tipping lever which is mounted on a joint bolt and provided with a projection, and which is affixed to the offtake and projects into an opening provided in the hood top, and immediately upon the starting up of the separator it locks the offtake to the hood with its projection by means of the permanent magnets.

It is advantageous to make the drum parts on which the permanent magnets are disposed out of non-magnetic materials.

The removal of the offtake, and of any other external separator parts such as the hood and the grippers, cannot be accomplished until, while the drum is at a standstill, the tipping lever is moved out of reach of the permanent magnets. This forestalls human error and accidents.

The safety device consists of simple parts not subject to wear, which do not come in contact with the rotating drum.

Thus, the invention provides an improvement in a centrifugal separator comprising a rotatable drum for the separation, a stationary hood surrounding the drum with clearance, at least one paring disk secured by releasable fastening means to the hood and disposed in the drum with clearance with respect to the drum and for removal of material separated in the drum, and each paring disk has a shaft for conveying the separated material away from the paring disk, and an offtake for receiving separated material from the shaft and which surrounds the shaft and is fastened to the hood. Said releasable fastening means is inaccessible when the offtake is in place on the hood. The improvement of the invention comprises a safety device for locking the offtake in place on the hood when the drum is rotating.

The safety device comprises first permanent magnet means mounted on the drum extending only part way around the drum axis, and second permanent magnet means mounted on the offtake for actuation in response to interaction of the first and second permanent magnet means when the drum is rotating. The second magnet means is effective to lock the offtake on the hood. The portion of the drum over which the first magnet member does not extend provides a relatively non-magnet zone which is long enough so the lock can be disengaged by disposing the second magnet means opposite said zone.

The safety device of the invention will now be explained with the aid of an embodiment represented in the appended drawing, wherein.

Figure 1:
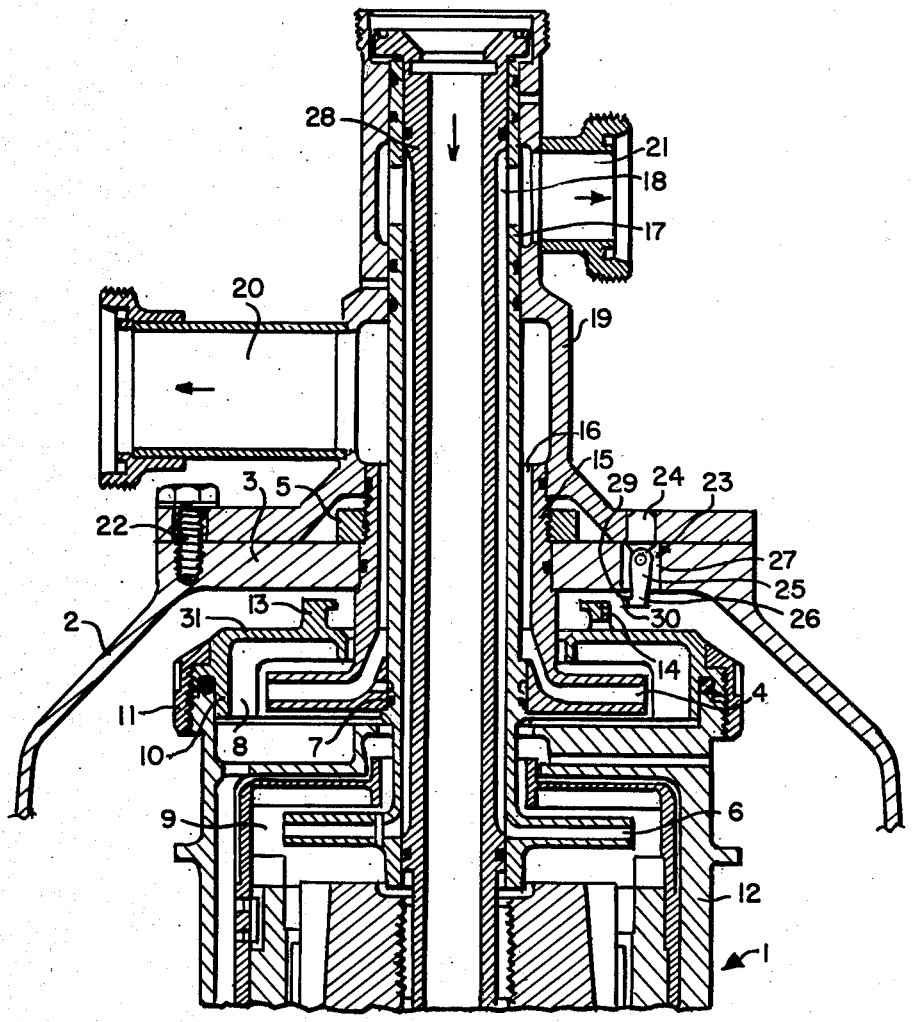
FIG. 1 shows the safety device in the unlocked state in a centrifugal separator having two paring disks for the withdrawal of two separated liquids.

In FIG. 1, the reference numeral 1 designates the centrifugal separator drum which is disposed for rotation on a vertical axis for the separation of liquid mixtures, and which is surrounded by a hood 2 disposed on the centrifuge frame which is not shown. The drum cover 10 is formed of a body portion 31 and a locking ring 11 which secures the body portion on the top portion 12 of the drum. The parting disk 4 provided for the withdrawal of the specifically heavier liquid is fixedly joined to the top 3 of the hood by means of a threaded lock ring 5, and the paring disk 6 provided for the withdrawal of the specifically lighter liquid is threaded into the paring disk 4 and sealed off by the gasket 7. The paring disks are disposed separately from one another, one in an upper paring chamber 8 and one in a lower paring chamber 9, clearance being provided between the disks and the drum.

The upper paring chamber 8 is defined at the top by body portion 31 of drum cover 10. On the drum top 10 there is provided a lipped ring 13 on which, in accordance with the invention, one or more permanent magnets 14 are provided.

The paring disk shaft 15 of paring disk 4, containing the withdrawal passage 16 for the specifically heavier liquid, and the paring disk shaft 17 of the paring disk 6, containing the withdrawal passage 18 for the specifically lighter liquid, are sealingly surrounded by an offtake 19 having the discharges 20 and 21, the offtake being fastened to the top of the hood by bolts 22. In accordance with the invention, a lock 23 which responds to magnetic and lever action is disposed on the offtake 19, and it consists of a joint bolt 24 fixedly set in the offtake and a tipping lever 25 with a projection 26, and projects into an opening 27 in the top of the hood.

An inlet tube 28 is provided centrally in the offtake, and it is carried sealingly with respect to the paring disk shaft 17 and the withdrawal passage 18, and does not come in contact with the rotating drum when it is installed or removed.

During operation, when the drum is rotating, the tipping lever 25 is pulled toward the permanent magnet 14 by the attraction of the latter and its projection 26 engages the edge 29 of the opening 27, thereby locking the offtake 19 to the hood, so that the offtake cannot be removed until the drum is stopped and the tipping lever can be turned out of the reach of the permanent magnet.

Figure 3:
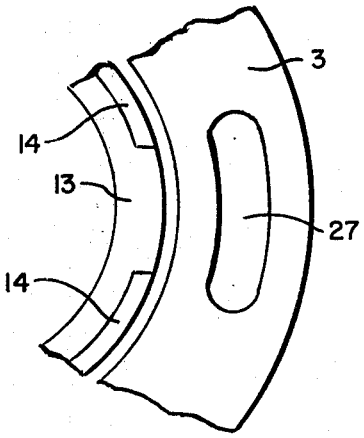
FIG. 3 is taken on line 3—3 of FIG. 2.

It is desirable for the opening 27 to be in the form of an elongated hole as shown in FIG. 3, so that, if desired, by rotating the offtake, the lock 23 and the projection 26 can be turned out of reach of the permanent magnet with the drum standing still. Likewise, the projection 26 can be provided with a permanent magnet 30 disposed for opposite polarity, so as to intensify the magnetic action.

Figure 2:
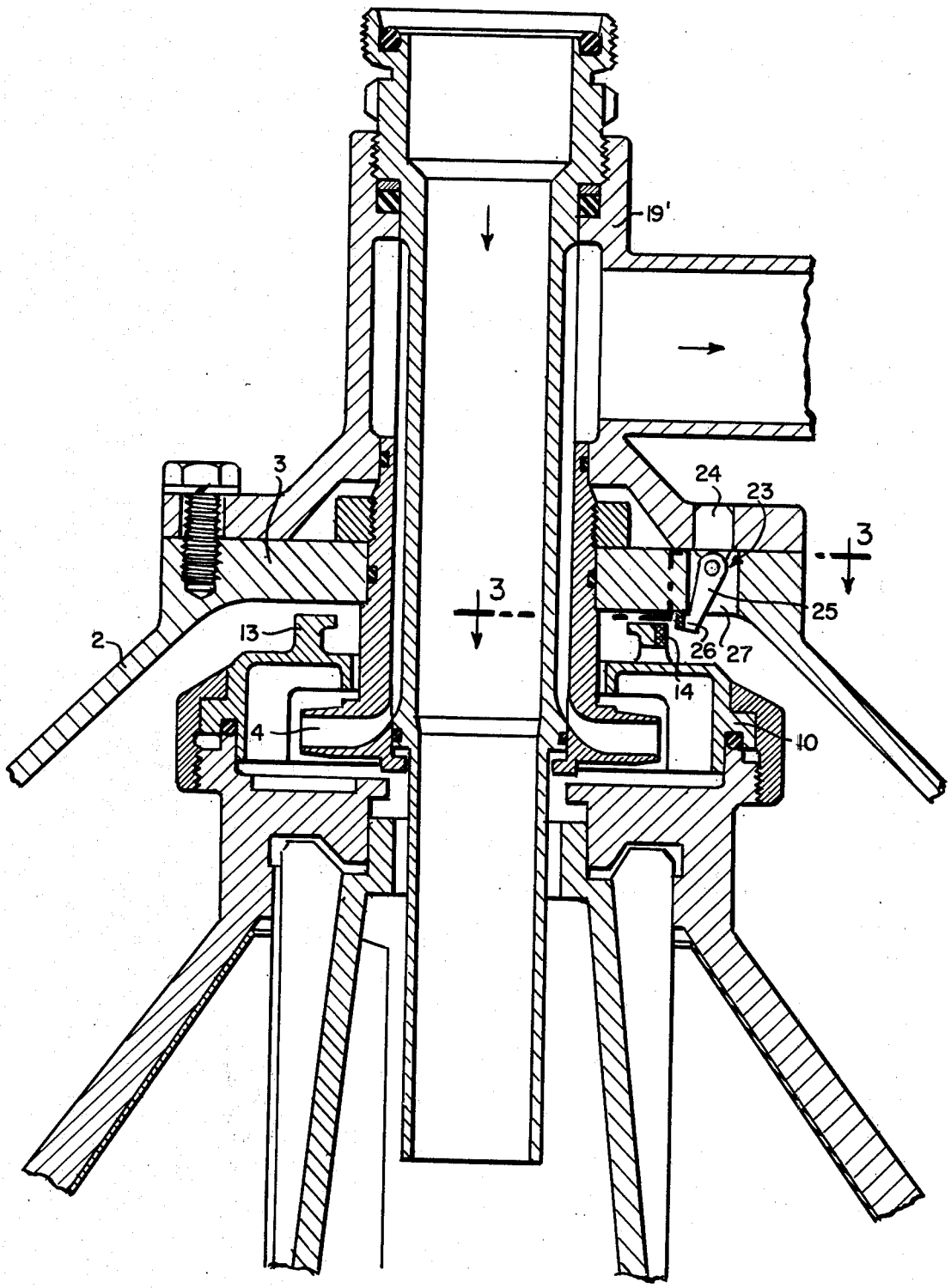
FIG. 2 shows the safety device in the locked state in a centrifugal separator having one paring disk for the withdrawal of one clarified liquid.

FIG. 2 shows the safety device in a centrifuge having only one paring disk 4' for the withdrawal of a clarified liquid, the tipping lever 25 of lock 23 being attracted to the chamber cover 10 by magnet 14 while the drum is revolving, and the tipping lever, with its projection 26, locks the offtake 19' to the top of the hood 3.

It may also be desirable to protect the tipping lever and the opening 27 in the hood top with a nonmagnetic covering, e.g., with plastic, whereby the magnetic action of the permanent magnet is not affected, but the tipping lever and the opening are protected against contamination.

As can be seen in FIG. 3, there is an area 32 around the drum over which the magnet 26 does not extend. That provides a relatively non-magnetic zone and the lock will disengage when the drum has stopped and the lock is opposite the non-magnetic zone.

What is claimed is:

1. In a centrifugal separator comprising a rotatable drum for the separation, a stationary hood surrounding the drum with clearance, at least one paring disk secured by releasable fastening means to the hood and disposed in the drum with clearance with respect to the drum and for withdrawal of material separated in the drum, each paring disk having a shaft for conveying the separated material away from the paring disk, and an offtake for receiving separated material from the shaft, surrounding the shaft and fastened to the hood top, said releasable fastening means being inaccessible when the offtake is in place on the hood, the improvement which comprises a safety device for locking the offtake in place on the hood when the drum is rotating, comprising first permanent magnet means mounted on the drum extending only part way around the drum axis, second permanent magnet means mounted on said offtake for actuation in response to interaction of the first and second magnet means when the drum is rotating, and effective when actuated to lock the offtake on the hood, the portion of the drum over which the first magnet member does not extend providing a relatively non-magnetic zone which is long enough so that the lock can be disengaged when the drum is not rotating by disposing the second magnet means opposite said zone.

2. Centrifugal separator of claim 1, having a drum cover, the first permanent magnet means being disposed on the drum cover.

3. Centrifugal separator of claim 2, the drum cover comprising a body portion and locking ring, the drum comprising a paring chamber, the drum cover body member defining the top of the paring chamber, the first permanent magnet means being disposed on the drum cover body member or on the locking ring.

4. Centrifugal separator of claim 3, comprising a drum top portion which is engaged by the locking ring, said drum top portion, and the drum cover body member and locking ring being of non-magnetic material.

5. Centrifugal separator of claim 4, the second permanent magnet comprising a tipping lever pivotally mounted on offtake and extending through an opening in the hood and having a projection which engages an edge of the opening locking the said separator member on the hood when the second magnet means is actuated.

6. Centrifugal separator of claim 5, the tipping lever being affixed to said offtake by a joint bolt.

7. Centrifugal separator of claim 5, the second magnet means being a permanent magnet contained in the projection of the tipping lever.

8. Centrifugal separator of claim 7, the opening through which the tipping lever extends being an elongated hole.

* * * * *